US012808572B2

(12) United States Patent
Garzón Molina

(10) Patent No.: US 12,808,572 B2
(45) Date of Patent: Nov. 24, 2026

(54) DEVICE FOR ADJUSTING AN AIR VOLUME FLOW

(71) Applicant: Viessmann Climate Solutions SE, Allendorf (DE)

(72) Inventor: Ricardo Garzón Molina, Würselen (DE)

(73) Assignee: VIESSMANN HOLDING INTERNATIONAL GmbH, Allendorf (DE)

( * ) Notice: Subject to any disclaimer, the term of this patent is extended or adjusted under 35 U.S.C. 154(b) by 124 days.

(21) Appl. No.: 18/768,720

(22) Filed: Jul. 10, 2024

(65) Prior Publication Data

US 2025/0020361 A1 Jan. 16, 2025

(30) Foreign Application Priority Data

Jul. 11, 2023 (EP) ..... 23184608

(51) Int. Cl.
*F24F 13/10* (2006.01)

(52) U.S. Cl.
CPC ..... *F24F 13/10* (2013.01)

(58) Field of Classification Search
CPC .. F24F 13/10; F24F 13/062; F24F 7/04; F24F 13/12; F24F 11/74; F24F 11/89
See application file for complete search history.

(56) References Cited

U.S. PATENT DOCUMENTS 5,340,358 A * 8/1994 Halupczok ..... F24F 13/062 454/305
2021/0302059 A1 9/2021 Haddeman et al.
2022/0120467 A1 4/2022 Anderson et al.

FOREIGN PATENT DOCUMENTS

DE 4405738 C1 * 6/1995 ..... F24F 13/06
DE 102021204015 A1 * 10/2022 ..... F04D 19/002
EP 0414022 B1 * 2/1994 ..... F24F 13/06
EP 2783166 B1 * 4/2018 ..... F15D 1/025
KR 102014770 B1 * 8/2019 ..... F24F 13/26
WO WO-2022101056 A1 * 5/2022 ..... F24F 13/105

OTHER PUBLICATIONS

European Search Report for EP 23 18 4608 dated Nov. 7, 2023.

* cited by examiner

*Primary Examiner* — Emmanuel E Duke
(74) *Attorney, Agent, or Firm* — Sughrue Mion, PLLC

(57) ABSTRACT

A device for adjusting an air volume flow, in particular in an air distribution network, having an air channel that defines a longitudinal centre axis. The device has a throttle in order to change a size of a cross section of the air channel. A flow element is arranged in the air channel, wherein the flow element has a cover, the cross section of which increases in a first direction away from the throttle. The cover has an end region which faces away from the throttle and which is inclined and which forms an outflow edge. The device optimizes the outflow behavior.

15 Claims, 5 Drawing Sheets

DEVICE FOR ADJUSTING AN AIR VOLUME FLOW

TECHNICAL FIELD

The present invention relates to a device for adjusting an air volume flow, in particular a supply air valve.

PRIOR ART

Air distribution networks are used particularly in buildings for the aeration and venting and sometimes for the air-conditioning of rooms. Controlled accommodation and office ventilation installations have by now become sophisticated systems which use centralized or decentralized ventilation apparatus.

The wall, ceiling or floor openings of a building have air passages having inserts which are connected to the air distribution network. Such air passages change the shape of the air flow and/or they regulate the air volume flow. Depending on the direction of the flow into the room or out of the room, they are referred to as supply air valves or exhaust air valves. They delimit the cross section in the air channel, wherein the size of this limitation can be selected by means of throttles.

Unfortunately, such supply and discharge air valves often cannot be adjusted in the installed state or only with a relatively large degree of complexity. Another disadvantage is that individual components of the valve depending on the degree of adjustment of the valve protrude to differing extents into the room, rise from the building wall and impair the visual appearance of the room.

Supply air valves, that is to say, valves through which the air flows into a room, additionally often have the disadvantage that they do not distribute the discharged air in a uniform manner. A seated or lying person who is directly exposed to the discharged air may find this to be unpleasant. Furthermore, strips of dirt deposits which are more visible than a uniform deposit are thereby produced. A non-homogeneous discharge behaviour additionally leads to increased noise generation.

Another disadvantage is that exhaust air valves, that is to say, valves through which air flows out of a room, often have a different shape from supply air valves. This leads to a rather disturbed appearance in the room.

WO 2022/101056 A1 discloses an air volume throttle valve with air directing members in the form of vanes of a rotor. The air directing members are formed in each case by a first and a second air direction unit which can be rotated relative to each other so that the spacing between the air directing members and consequently the cross section, which can be flowed through, of an air channel can be changed. This device enables a changing of the free flow cross section with a consistent location of the narrowest flow cross section. This facilitates the control of the valve.

SUMMARY OF THE INVENTION

Therefore, an object of the invention is to provide an improved device for adjusting a volume flow.

The device according to the invention for adjusting an air volume flow, in particular in an air distribution network, has an air channel which can be flowed through and which defines a longitudinal centre axis. The device has a throttle in order to change a size of a cross section, which can be flowed through, of the air channel. A flow element is arranged in the air channel, wherein the flow element has a cover, the cross section of which increases in a first direction away from the throttle. The cover has an end region which faces away from the throttle and which is inclined in a second direction and which forms an outflow edge, wherein the second direction is opposite the first direction. The cover is the mantle or the circumferential outer shape of the flow element.

The arrangement of the end region with the outflow edge and the second flange leads to the air which is discharged from the valve being directed in the direction of the ceiling or wall.

The air flow is already applied early, that is to say, close to the air supply valve, to the wall or to the ceiling. Return flow regions are thereby avoided. There are consequently hardly any dirt or dust deposits on the wall or the ceiling.

As a result of the curved shape of the outlet region of the air channel, produced by the inclined outflow edge, turbulence is formed. The turbulence mixes with the subsequent air flow which is orientated by the throttle in a jet-like manner. A homogeneous discharge over 360° is thereby enabled.

Preferably, the cross section of the outflow edge is wedge-shaped.

This upwardly directed outflow edge can be used with differently configured throttles.

Preferably, the outflow edge is configured in a circumferential manner. It preferably has no interruptions which could interrupt the homogeneous distribution of the discharged air.

Preferably, the flow element is configured to be impermeable to air so that all of the air which is guided through the device flows along the covering face of the flow element.

Preferably, the flow element is configured in a bell-like manner. Preferably, the bell-like member expands in the direction towards the outlet, that is to say, the interior of the building.

Preferably, the cover or at least the end region with the outflow edge is configured in a rotationally symmetrical manner. The air flow is optimized when the cover is inwardly curved with the exception of the end region facing away from the throttle.

The outer surface of the cover is preferably flat, that is to say, without any protrusions and recesses. The air flow can thereby expand in an unimpeded manner. Preferably, at least in the outlet region of the air channel, that is to say, in the region of the outflow edge, there are no chicanes or obstacles which protrude into the air channel.

Preferably, the device has a circumferential face which is opposite the end region of the cover and which together with the end region forms the outlet region, that is to say, an outlet opening of the air channel. When this circumferential face is also inclined in the second direction, the flow behaviour is further optimized.

Preferably, the circumferential face is configured to be flat in order to have no interference elements.

The outlet opening is preferably in the form of an annular channel which is defined by the end region which forms the outflow edge and by the circumferential face, wherein the annular channel has a cross sectional surface-area which is consistent in the direction of the longitudinal centre axis. This leads to further optimization of the flow behaviour.

A further optimization is present when the inclination of the end region in the region of the outflow edge and the inclination of the circumferential face are identical.

In preferred embodiments, the device has a housing in which the throttle and the flow element are arranged. The circumferential face is a flange of the housing, wherein the flange is configured for abutment against a wall. This facilitates the assembly of the device in a wall opening and additionally enables an arrangement of the outlet opening of the air channel in a position close to the ceiling or wall.

This local arrangement is additionally facilitated when, in the state in which the device is installed in the wall opening, the second direction leads towards the wall.

The assembly and adjustment of the device is facilitated when the flow element is configured in a hollow manner and can be closed with a lid.

Preferably, the position of the flow element relative to the housing or relative to the wall surface does not change when the setting of the throttle changes. Preferably, the cross section of the outlet channel or the outlet opening of the air channel also does not change when the setting of the throttle changes.

Further embodiments are set out in the dependent claims.

BRIEF DESCRIPTION OF THE DRAWINGS

Preferred embodiments of the invention are described below with reference to the drawings which are merely for the purpose of explanation and are not intended to be interpreted in a limiting manner. In the drawings.

DESCRIPTION OF PREFERRED EMBODIMENTS

Figure 1:
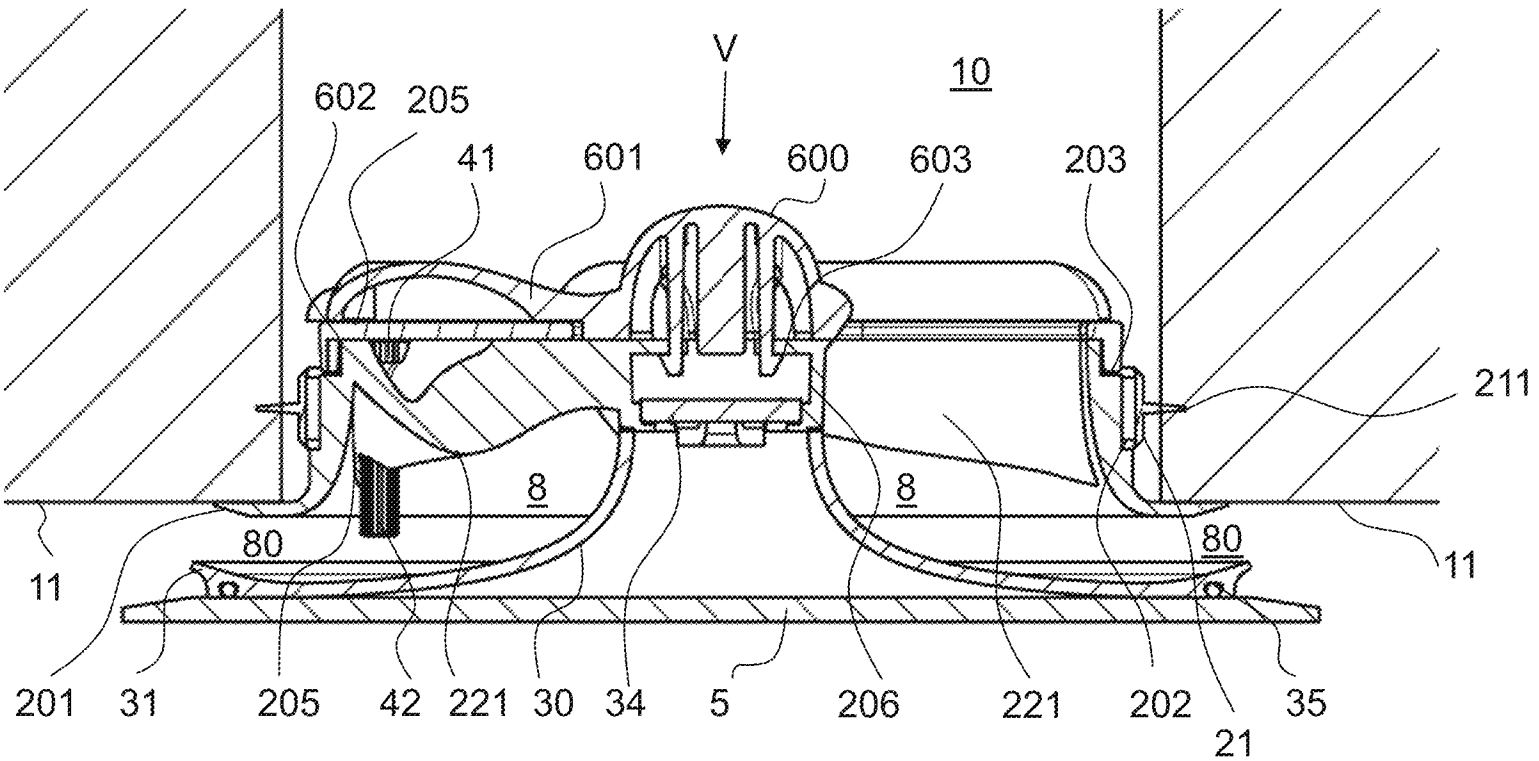
FIG. 1 shows a longitudinal section through a device according to the invention in a state installed in a wall opening.

FIG. 1 shows a valve V according to the invention which is installed in a wall opening 10 of a wall 11. The wall opening 10 is preferably part of an air distribution network of a building. The terms "top" and "bottom" used in this text refer to the installation position of the valve in the wall opening of a building ceiling. If the wall opening is located in another wall of a building, these terms are intended to be interpreted accordingly.

The valve V is preferably an air supply valve which directs air from an air distribution network through a wall opening into a building space. However, it can also be used as an exhaust air valve which directs air from the building space into the wall opening 10.

The valve V is described below as a supply air valve, wherein it is configured identically to an exhaust air valve in terms of its function.

Figure 2:
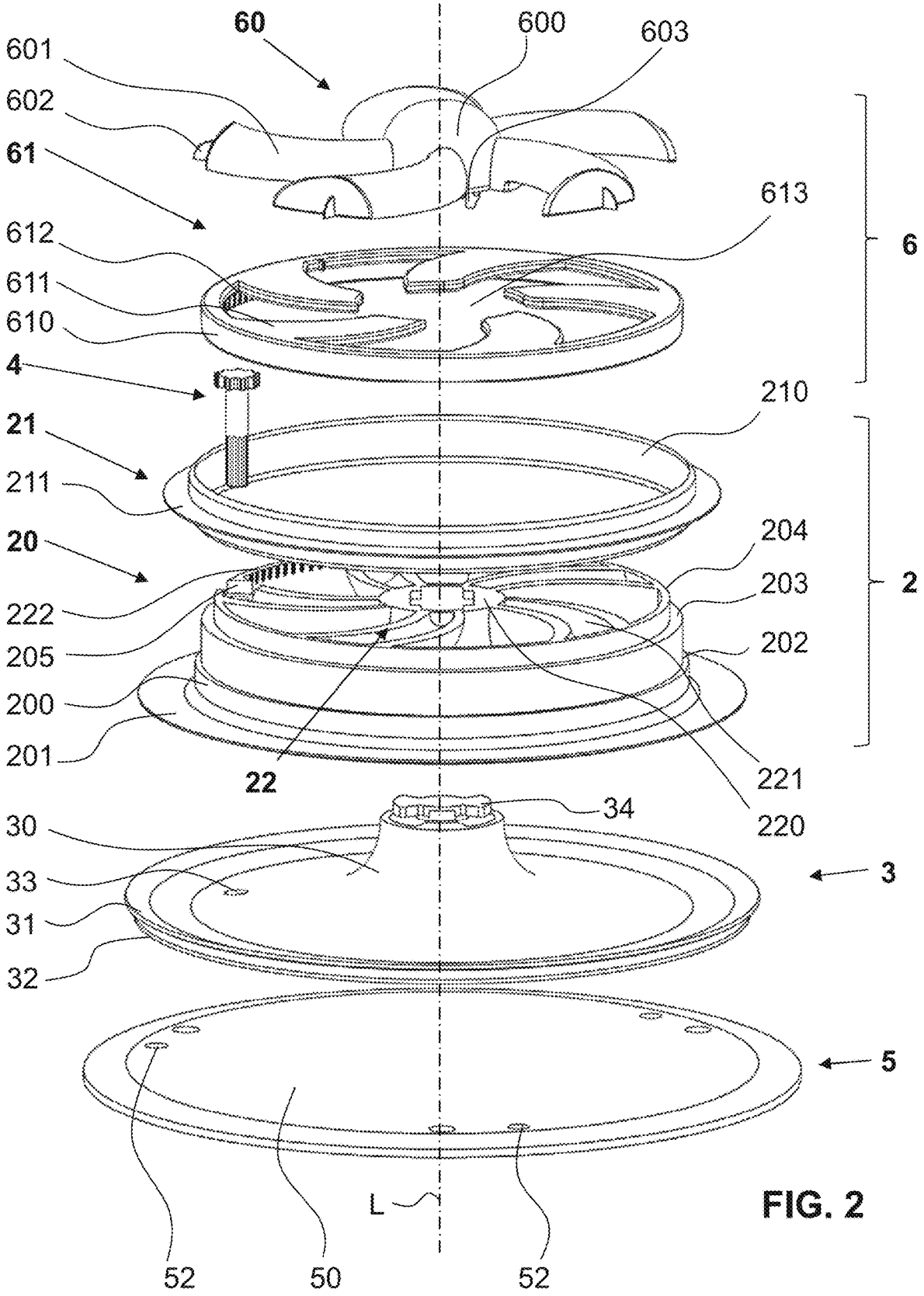
FIG. 2 shows an exploded illustration of the device according to FIG. 1 from above.
Figure 3:
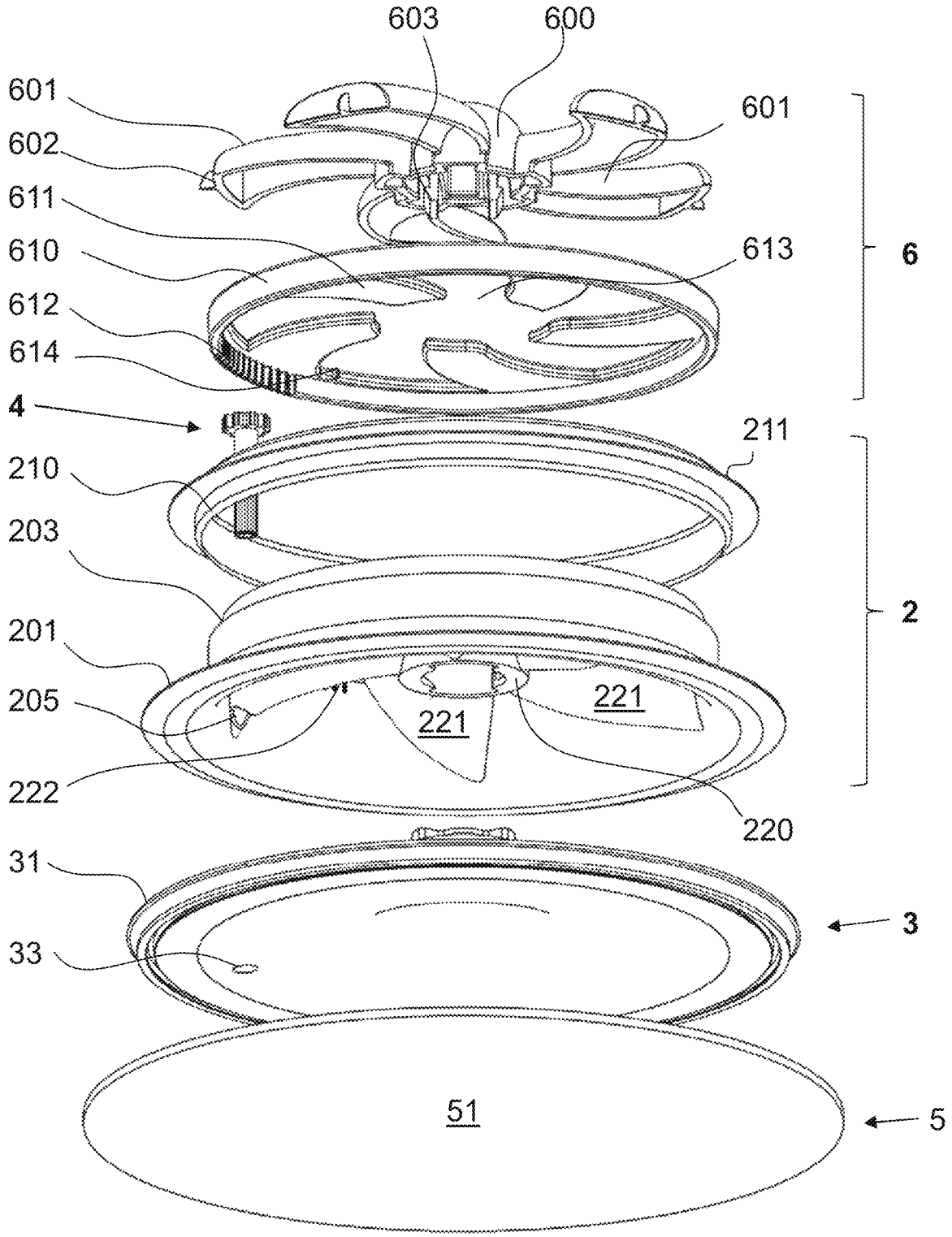
FIG. 3 shows a first exploded illustration of the device according to FIG. 1 from below.
Figure 4:
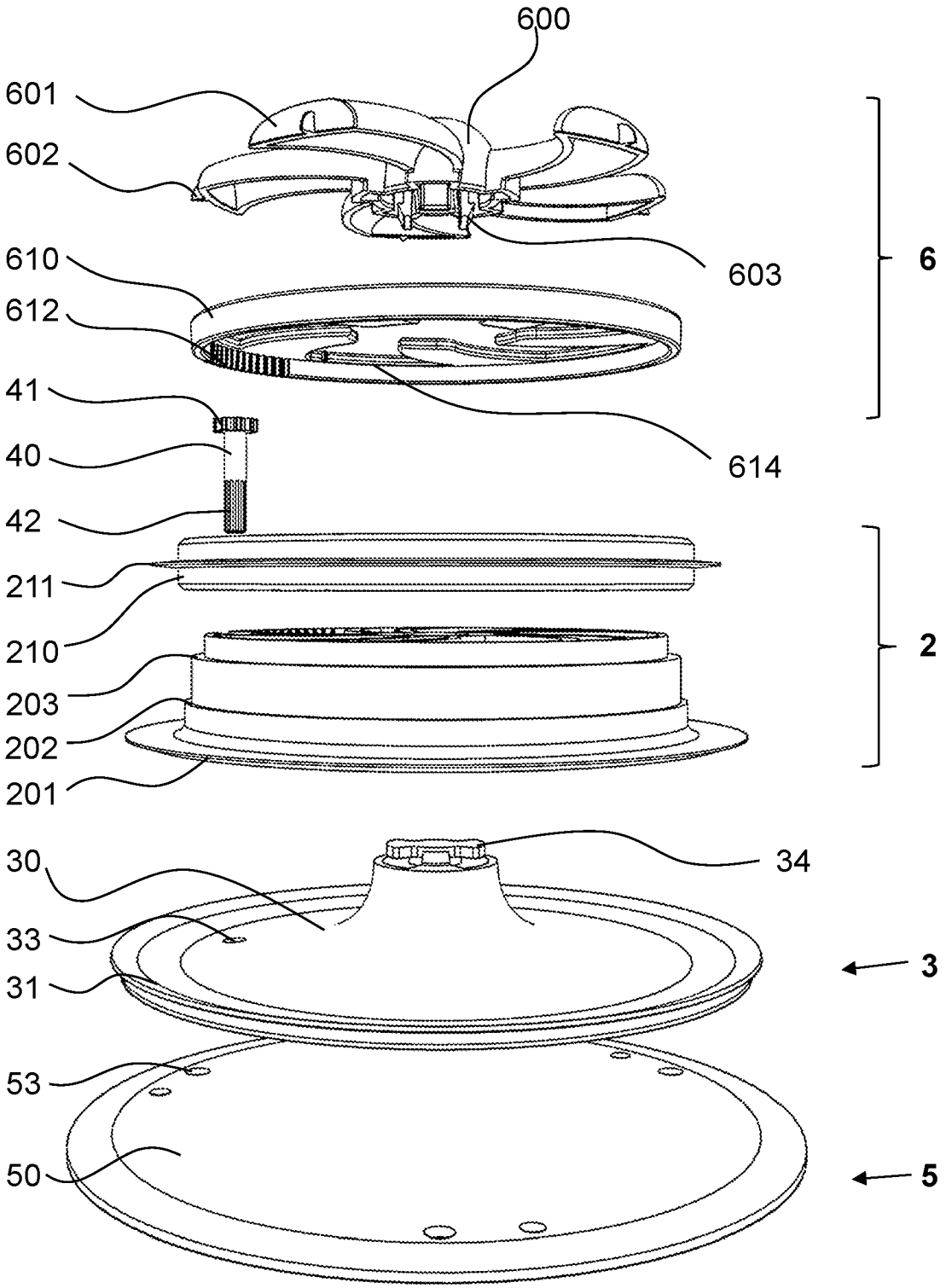
FIG. 4 FIG. 4 shows a second exploded illustration of the device according to FIG. 1 from below.

The valve V has, as can be clearly seen in FIGS. 2 to 4, a housing 2, an inner flow element 3, a rotary pin 4, a lid 5 and a throttle 6.

The housing 2 is preferably configured in two parts. It preferably has a round cross section. A first housing portion 20 has a hollow circular-cylindrical base member 200, the lowest end of which has a radially outwardly protruding flange 201. With this flange 201, the valve V bears on the building wall 11, as can be seen in FIG. 1. The first flange 201 is preferably configured in a rigid manner and acts as a stop when the valve V is inserted into the wall opening 10, as can be seen in FIG. 1. It forms a closure for covering irregularities in the surrounding wall 11. The first flange 201 further serves to delimit an outlet opening 80 of an air channel 8, as described below in the text. The first flange 201 has to this end an inclination towards the wall 11. Preferably, the inclination is achieved by means of continuous thinning of the flange 201 in the direction towards the outer circumferential edge thereof. The downwardly directed surface of the flange 201 is configured to be flat, that is to say, with no projections or recesses. The flange 201 is configured circumferentially, in a closed manner and preferably without interruptions. Possible interruptions are holes for screwing the housing 2 in the wall opening 10. Preferably, however, the housing 2 is fixed in the wall opening in another manner.

The base member 200 has on the outer circumference thereof a first step 202 and a second step 203. A circumferential upper end face 204 is preferably configured in a planar manner. The upper end face 204 has a recess 205 for passage of the rotary pin 4.

In the upper region of the first housing portion 20, a third throttle portion 22 which is described below in the text together with a first and a second throttle portion 60, 61 of the throttle 6 is formed.

A second housing portion 21 has a narrow, hollow-cylindrical or annular base member 210. It is surrounded by a radially protruding second flange 211. The second flange 211 is preferably in the form of a flexible sealing and/or clamping ring. It is used for sealing and releasably fixing the valve V in the wall opening 10, as can be seen in FIG. 1. The wall opening 10 preferably has for this purpose a round cross section. The second flange 211 may be injected on, formed integrally on or connected to the second base member 210 in another manner.

The second housing portion 21 surrounds the upper region of the first housing portion 20. It is positioned on the first step 202 and preferably extends up to the second step 203.

The housing 2 surrounds a central air channel which defines a longitudinal centre axis L and radial directions.

In the housing 2, there is arranged the inner flow element 3 which extends downwards towards the building interior, as can be seen in FIG. 1. The inner flow element 3 is preferably configured in a hollow manner and can be closed downwards with the lid 5. The flow element 3 is configured to be closed in an upward direction with the exception of a through-opening 33 for the passage of the rotary pin 4.

The flow element 3 is preferably configured in a substantially rotationally symmetrical manner. It has a bell-like form with a downwardly expanding cross section and inwardly curved cover 30. The flow element 3 preferably extends up to the outer edge of the first flange 201 or beyond.

The flow element 3 is retained in a fixed manner in the first housing portion 20, preferably with a bayonet closure or with another releasable and reproducible connection. These coupling elements are preferably arranged in the region of the longitudinal centre axis L. In FIG. 2, a second coupling element 220 of the first housing portion 20 and a corresponding coupling element 34 of the flow element 3 can be clearly seen. It is a plug and rotary connection in the form of a bayonet closure.

As can be seen in FIG. 1, between the first housing portion 20 and the flow element 3 there is formed a flow channel which is referred to in this instance as an air channel 8. It leads from the wall opening 10 through the throttle 6 and through an annular gap between the first flange 201 and the cover 30 of the flow element 3 into the building interior. The annular gap forms the outlet opening 80 of the air channels 8. The gap is generally always of the same size, regardless of the adjustability of the throttle 6 as described below in the text. The outflow cross section of the valve V consequently remains the same even when the setting of the throttle 6 is changed and consequently when the cross section of the throttle 6 which can be flowed through is changed.

An upwardly bent outflow edge 31 of the flow element 3 optimizes the outflow behaviour, as can be seen in FIG. 1. The outflow edge 21 is formed by an end region of the cover 30 which is spaced apart from the throttle 6. It is circumferential and preferably uninterrupted. The cover 30 is at least in this end region, but preferably over the entire surface facing the throttle 6, configured to be flat. This surface is flowed over by the air flow.

The outflow behaviour is further optimized as a result of the first flange 201 which is also inclined upwards. Preferably, the inclinations are identical so that the outlet opening has a consistent cross section in the direction of the longitudinal centre axis L.

Preferably, the cover 30 has a slightly larger diameter than the second flange 201, as can be clearly seen in FIG. 1.

The flow element 3 has a lower annular edge which forms a planar lower end face 32 against which the lid 5 bears. The annular edge surrounds an inlet opening which leads into a hollow inner space. The lid 5 has a base plate 50 having a preferably planar lower end face 51. It can preferably be fitted to the flow element 3 and removed from it in a tool-free manner. To this end, magnets are arranged in both components. The magnets of the flow element 3 can be seen in FIG. 2. They are designated 35. The magnets of the lid 5 can be seen in FIGS. 2 and 4. They are designated 52.

The flow element 3 is preferably arranged in a manner fixed in position with respect to the housing 2 and is preferably non-adjustable at least in the direction of the longitudinal centre axis L, that is to say, axially.

The throttle 6 is arranged in the upper region of the valve V. Any throttles can be used. Preferably, it has adjustable elements for selectively narrowing the central air channel. In other embodiments, the throttle cannot be adjusted or it has only an open and a closed position.

The throttle illustrated in this instance has a changeable cross section which determines the air flow which can flow through the central air channel. This changeable cross section which is determined by the throttle 6 is referred to in this text as a cross section which can be flowed through.

Following in the flow direction of the throttle 6, that is to say, facing the building interior, the cross section of the central air channel can preferably no longer be adjusted. However, it is not necessarily the same size everywhere. This following cross section is preferably formed by the spacing between the preferably inwardly curved inner wall of the housing 2 and the cover 30 of the flow element 3.

In this embodiment, the throttle 6 comprises three components. The first throttle portion 60 is connected in a rotationally secure manner to the housing 2 and/or to the third throttle portion 22. The third throttle portion 22 is configured integrally with the housing 2 and also in a rotationally secure manner with respect to the first throttle portion 60. The second throttle portion 61 is arranged between the first and the third throttle portion 60, 22 and can be rotated or pivoted about the longitudinal centre axis L.

In other embodiments, the third throttle portion 22 is also an independent component which is preferably connected to the housing 2 in a rotationally secure manner. In other embodiments, only the first and second throttle portions 60, 61 are provided, but no third throttle portion 22, or only the second and the third throttle portions 61, 22 are provided, but no first throttle portion 60. If only two throttle portions are provided, the second throttle portion 61 is preferably also configured with an optimized configuration of the inflow or outflow face.

The first throttle portion 60 has blocking elements in the form of rotor-like first vanes 601 which extend outwards from a common central portion. This central portion forms a first coupling element 600. In this example, five first vanes 601 are provided. However, three, four, six or a different number of vanes can also be used.

Figure 5:
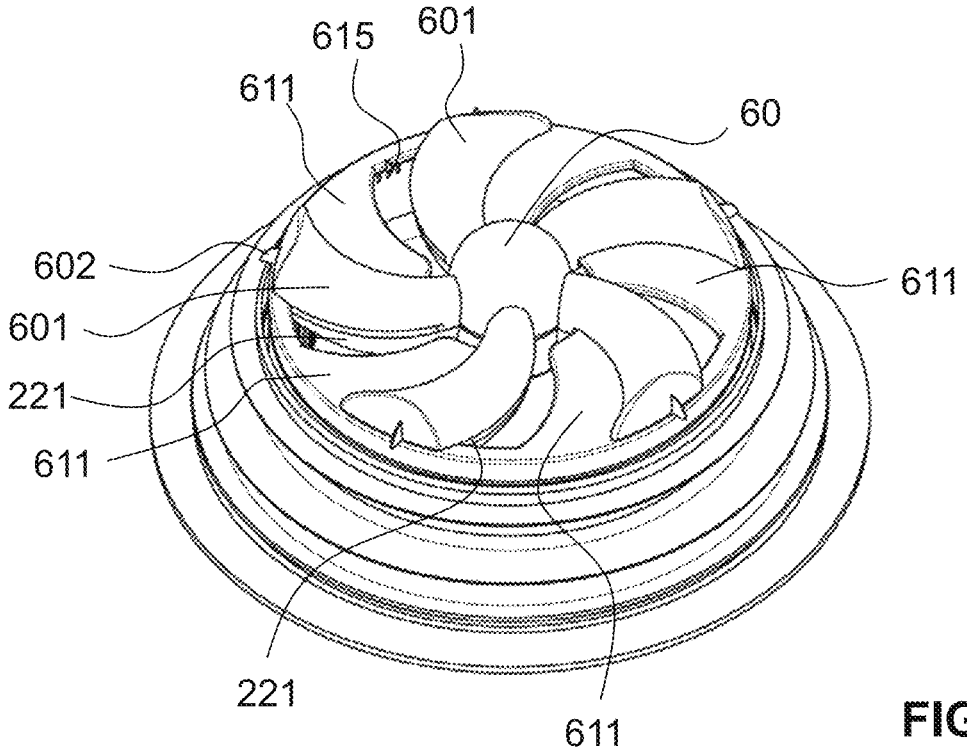
FIG. 5 shows a perspective view of the device according to FIG. 1 from above in a partially closed position of the throttle and FIG. 6 shows a perspective view of the device according to FIG. 5 in a completely open position of the throttle.
Figure 6:
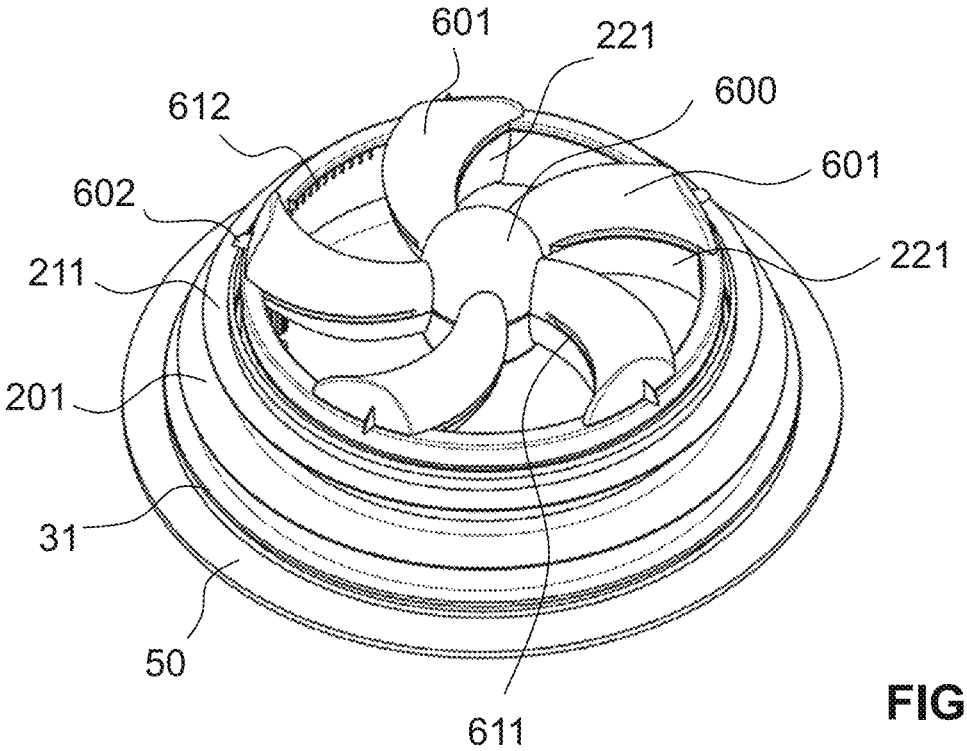

At the end faces of the free ends of the first vanes 601, hooks or protrusions 602 are formed on. They are used for the assembly of exhaust air filters and/or hoods. They are positioned, for example, on the upper end face of the second throttle portion 61. This can be clearly seen in FIGS. 1, 5 and 6.

The first vanes 601 expand in the direction towards the free ends thereof. Preferably, all the vanes 601 are formed in an identical manner and are of the same size. The first vanes 601 are configured to be bent in a radial direction. Preferably, the face which is left free between two vanes 601 corresponds to the face of a vane 601.

The upper inflow faces of the first vanes 601 are preferably configured in a bent manner so that an aerodynamically favourable body is formed.

The third throttle portion 22 has blocking elements in the form of third vanes 221 which form geometric counterpieces with respect to the first vanes 601. They are consequently in this example also configured to be bent in a radial direction. These third vanes 221 do not terminate freely but instead their peripheral ends are formed on the inner wall of the first housing portion 20. The central ends thereof merge integrally into a central portion which is formed by the second coupling element 220.

The first coupling element 600 has hooks 603 which project downwards and which engage in receiving openings of the second coupling element 220. In this manner, the first throttle portion 60 is connected in a rotationally secure manner to the third throttle portion 22 and also to the housing 2.

When the valve V is assembled, the first and third vanes 601, 221 are in alignment with each other. The first and third vanes 601, 221 are located in a congruent manner one above the other. Preferably, the free surface of the third vanes 221 is also configured in a bent manner. This outflow face is consequently also aerodynamically optimized. Preferably, the flow faces of the first and third vanes 601, 221 are bent in an identical manner so that the valve V forms identical inflow and outflow faces and can consequently be used both for supply and exhaust air.

The intermediate second throttle portion 61 has an outer ring 610. On the upper end of the ring 610, inwardly protruding blocking elements in the form of second vanes 611 are formed. The outer ring 610 is positioned with the free lower end of the cover thereof on the second step 203 of the housing 2. It is additionally positioned with the inwardly protruding upper circumferential edge on the upper end face 204 of the housing 2. This can be clearly seen in FIGS. 1, 2, 3 and 4.

The ring 610 and consequently the second throttle portion 61 can be rotated about the longitudinal centre axis L, wherein it is guided by the base member 210 of the second housing portion 21 during rotation and is fixed in the axial position thereof by the projections 602 of the first throttle portion 60.

The second vanes 611 of the second coupling portion 61 terminate freely in the direction towards the longitudinal centre axis L. They are also configured in a bent manner, wherein they preferably have the same bending radii as the first and third vanes 601, 221. The same number of second vanes 611 as there are first and third vanes 601, 221 are preferably provided. Preferably, the same number of second vanes 611 as there are first and third vanes 601, 221 are provided. The second vanes 611 can be configured in a flat manner. Other embodiments are possible.

The second throttle disc 61 consequently forms a flat disc with a circumferential guiding cover, wherein the disc is arranged between the planar end faces of the first and third vanes 601, 221 and can be rotated relative thereto. The rotation is preferably continuous. In other embodiments, it is stepped. In all cases, optical, haptic and/or acoustic means are preferably provided in order to indicate to the user that discrete positions of the throttle disc 61 have been reached. Furthermore, such means protect against unintentional adjustment.

The rotation of the throttle disc 61 serves to adjust the valve V. It is preferably carried out manually. Alternatively or additionally, however, it may also be carried out in a motor-operated manner.

The adjustment can preferably also be carried out with the valve V already mounted in the wall opening 10. This can be carried out in a simple embodiment by the flow element 3 and the lid 5 being removed. In a preferred embodiment which is illustrated in this instance by way of example, if at all, only the lid 5 is removed. The through-opening 33 in the cover 31 of the flow element 3 enables access to the adjustment element, in this instance the rotary pin 4. This can be clearly seen in FIGS. 1 to 4.

The rotary pin 4 has a pin 40, a head 41 which is in the form of a gear and a knurling 42 on the circumference of the free end of the pin 40. The knurling 42 increases the gripping ability when the rotary pin 4 is rotated by hand without additional tools being used. However, tools can also be used for this purpose.

The rotary pin 4 extends through the recess 205 of the first housing portion 20, as can be seen in FIGS. 1 and 2. In this instance, the head 41 is positioned on the first housing portion 20.

The second throttle portion 61 has in a region of the inner circumference thereof a tooth arrangement 612. The gear of the head 41 engages as a result of the recess 205 in this tooth arrangement 612. By rotating the rotary pin 4, the second throttle portion 61 can be rotated about the longitudinal centre axis L. The position of the second vane 611 relative to the first and third vanes 601, 221 can consequently be manually adjusted.

Preferably, the first housing portion 20 has in addition to the recess a scale 222 which cooperates with a reference 614 of the second throttle portion 61. The setting of the throttle can thereby be noted and the rotary position of the vanes with respect to each other can be identified. This can be seen in FIGS. 2 and 3.

The device according to the invention for adjusting a volume flow optimizes the outflow behaviour.

The invention claimed is:

1. A device for adjusting an air volume flow in an air distribution network, wherein the device has an air channel which defines a centre axis, and wherein the device has a throttle in order to change a size of a cross section of the air channel through which air can flow, wherein the device has a flow element defining a portion of the air channel, wherein the flow element has a cover, a cross section of the cover taken in a plane orthogonal to the centre axis increases in a first direction along the centre axis away from the throttle, and wherein the cover has an end region which is inclined towards the throttle and which forms an outflow edge.

2. The device according to claim 1, wherein the outflow edge is configured in a circumferential manner.

3. The device according to claim 1, wherein the flow element is configured to be impermeable to air so that the air which is guided through the device flows along a face of the cover of the flow element.

4. The device according to claim 1, wherein the flow element is configured in a bell-like form.

5. The device according to claim 1, wherein the cover is curved inwards with the exception of the end region.

6. The device according to claim 1, wherein the outflow edge is configured in a rotationally symmetrical manner.

7. The device according to claim 1, further comprising: an outer surface of the cover configured to be flat.

8. The device according to claim 1, wherein the device has a circumferential face which is opposite the end region of the cover and which together with the end region forms an outlet opening of the air channel.

9. The device according to claim 8, wherein the circumferential face has a surface facing the air channel that is inclined away from the end region of the cover.

10. The device according to claim 9, wherein the inclination of the end region in the region of the outflow edge and the inclination of the circumferential face are identical.

11. The device according to claim 8, wherein the circumferential face is configured to be flat.

12. The device according to claim 8, wherein the outlet opening is in the form of an annular channel which is defined by the edge region which forms the outflow edge and by the circumferential face, wherein the annular channel has a uniform cross-section in a direction of the centre axis.

13. The device according to claim 8, wherein the device has a housing in which the throttle and the flow element are arranged and wherein the circumferential face is a flange of the housing, wherein the flange is configured for abutment against a wall.

14. The device according to claim 1, wherein the device is installed in a wall opening, wherein the first direction leads away from the wall.

15. The device according to claim 1, wherein the flow element can be closed with a lid.

* * * * *